US005145285A

United States Patent [19]

Fox et al.

[11] Patent Number: 5,145,285

[45] Date of Patent: Sep. 8, 1992

[54] DISCONTINUOUS STRUCTURAL REINFORCING ELEMENTS AND METHOD OF REINFORCING AND IMPROVING SOILS AND OTHER CONSTRUCTION MATERIALS

[76] Inventors: Nathaniel S. Fox, 4635 Riveredge Cove, Lithonia, Ga. 30058; Evert C. Lawton, 7955 S.W. 198 Terrace, Miami, Fla. 33189

[21] Appl. No.: 826,656

[22] Filed: Jan. 21, 1992

Related U.S. Application Data

[63] Continuation of Ser. No. 523,366, May 15, 1990, abandoned.

[51] Int. Cl.[5] ..... E02D 3/00

[52] U.S. Cl. ..... 405/258; 106/900; 404/70; 405/229; 405/266; 52/659

[58] Field of Search ..... 405/29, 229, 258, 266, 405/267; 52/659; 106/644, 900; 109/83; 404/30, 45, 70, 81, 134

[56] References Cited

U.S. PATENT DOCUMENTS

| | | | |
|---|---|---|---|
| 1,474,389 | 11/1923 | Trowbridge et al. | 109/83 |
| 1,976,832 | 10/1934 | Brown | 52/659 |
| 2,062,944 | 12/1936 | Sloan | 404/70 |
| 2,909,037 | 10/1959 | Palmer | 405/29 |
| 3,165,036 | 1/1965 | Schmidt | 404/81 X |
| 3,355,894 | 12/1967 | Vidal | 405/29 X |
| 3,846,085 | 11/1974 | Dunn | 404/70 X |
| 4,033,781 | 7/1977 | Hauser et al. | 52/659 X |
| 4,078,940 | 3/1978 | Marsden | 106/644 |
| 4,370,390 | 1/1983 | Burk | 52/659 X |
| 4,645,381 | 2/1987 | Leflaive et al. | 405/258 |
| 4,662,946 | 5/1987 | Mercer | 106/900 X |
| 4,790,691 | 12/1988 | Freed | 405/263 |
| 4,916,855 | 4/1990 | Halliday et al. | 405/258 X |

FOREIGN PATENT DOCUMENTS

| | | | |
|---|---|---|---|
| 2388945 | 12/1978 | France | 405/29 |
| 12413 | 2/1981 | Japan | 405/258 |
| 151711 | 6/1988 | Japan | 405/258 |

*Primary Examiner*—David H. Corbin
*Attorney, Agent, or Firm*—Hopkins & Thomas

[57] ABSTRACT

A multidimensional structural reinforcing element is disclosed, the element designed for inclusion within a matrix of soil, concrete, stone, and other materials to improve the index properties of the matrix. The elements have a hub portion with arms extending radially therefrom. The arms may include additional structural elements such as cubes or spheres on the distal ends thereof and the surface of the elements may be roughened to increase the surface area and the gripping function of the elements relative to the matrix material.

17 Claims, 1 Drawing Sheet

DISCONTINUOUS STRUCTURAL REINFORCING ELEMENTS AND METHOD OF REINFORCING AND IMPROVING SOILS AND OTHER CONSTRUCTION MATERIALS

This is a continuation of copending application Ser. No. 07/523,366 filed on May 15, 1990, now abandoned.

BACKGROUND OF THE INVENTION

This invention relates generally to a composite construction engineering material consisting of structural reinforcing elements of discontinuous, non-fibrous configuration, i.e., three-dimensional structural reinforcing elements rather than slender, threadlike structures (or combinations of threadlike structures). This composite construction engineering material can be constructed to possess enhanced engineering properties, as well as improved index properties, as compared to the unreinforced matrix material. This invention relates also to elements of a composite construction engineering material, with improved characteristics. It further relates to methods to incorporate these special structural reinforcing elements into an artificial construction material or to form an essentially artificial construction material.

The projected primary application of this invention relates to the improvement, reinforcement, enhancement, and/or stabilization of soil or soil-like materials in geotechnical engineering applications. However, additional applications include, but are not necessarily limited to, the improvement, reinforcement, enhancement, and/or stabilization of other construction materials such as, but not limited to, Portland cement, concrete, asphalt, lime, stone, slag, or any mixture or combination of these materials with or without soil. Because the potential applications within the construction industry appear to be numerous, a complete discussion of all these applications is not practicable. Therefore, the discussion related to the incorporation of non-fibrous, discontinuous, structural reinforcing elements within construction engineering materials will be limited to geotechnical engineering applications using soil or stone as the matrix material. The discussion, however, applies in a general sense (and in a specific sense, where appropriate) to the incorporation of these elements within any construction engineering material.

In the construction industry, both in building foundation construction and on-grade construction, including slabs and pavement systems, as well as earthwork projects such as dams, levees, embankments, fills and retaining walls, the engineering and index properties of soils significantly influence the end product. The characteristics of the soil which are usually the most influential, include the shear strength of the soil, the consolidation or compression characteristics of the soil, the compactibility of the soil, the density of the soil, and the permeability of the soil. These characteristics influence the bearing capacity of foundations, the settlement of structures, the lateral earth pressure against retaining walls, the performance and useful life of slabs and pavements, the drainage characteristics of subsoils, and the slopes of embankments.

The present invention improves these characteristics by producing a composite (reinforced) geotechnical engineering material or an artificial soil material, which can increase the strength, decrease the compressibility, increase the ductility, increase the permeability, decrease the weight, and increase the constructibility (compactibility) in comparison with unreinforced soil. These improvements can be achieved without the use of continuous reinforcement elements (commonly called geotextiles or geofabrics) or without the use of additive fibers.

Soil reinforcement in the form of stabilizing or improving soil characteristics for construction purposes is not a new concept. Chemical stabilization by introducing hydrated lime or quicklime into a soil was utilized two thousand years ago. Introduction of sticks, tree parts, or straw to soils to improve soil properties was practiced by ancient peoples on a number of continents. However, manufactured products introduced into a soil matrix to enhance its properties are a relatively recent innovation. The impetus to this industry was provided by the introduction of flat, thin strips of reinforcing materials to a soil backfill. The strips were constructed of galvanized steel, and later synthetic materials such as polypropylene have been used. These strips were placed horizontally between lifts of soil backfill. The most common use of the invention was to improve retaining wall design and performance.

Subsequently, the use of woven and non-woven fabrics and thermoplastic grids has been developed. These materials, often called geotextiles or geofabrics, are generally constructed of thermoplastics or polyesters. They are utilized as continuous sheets, normally placed horizontally or near horizontally between lifts of soil. The primary purposes of these reinforcing sheets are to improve the bearing capacity of the soil and to reduce lateral soil pressures against retaining walls or to increase stability within sloped embankments.

More recently, there has been some activity involving the introduction of non-continuous, discrete fibers into soil matrixes. This basic technique began with the reinforcement of concrete to improve various characteristics of the concrete, including tensile strength, ductility and crack resistance. Fiber materials used include steel fibers and polypropylene fibers. Fibers have been subsequently introduced into soils on a limited scale. Research has been documented since 1980, on the introduction of natural and synthetic fibers into a soil matrix for the purpose of improving the composite material's engineering properties, mainly its shear strength and stress-strain response.

An example of the introduction of fiber elements into the soil to enhance the properties of the composite soil mixture has been described in U.S. Pat. No. 4,790,691. This patent discloses the use of additive fibers varying from 0.1 to 5 percent by weight to that of the soil matrix. The single method disclosed for constructing the composite mixture is to mix the fiber additives together with the soil to form a blend. Constructing an improved composite geotechnical engineering material or an artificial soil consisting of discontinuous structural reinforcing elements of a non-fibrous configuration appears not to have been attempted heretofore. Methods of mixing which include both blending the discontinuous reinforcing elements with the soil, and also placing these elements in layers between soil lifts, has not been previously attempted. Use of synthetic, non-fibrous reinforcing elements by themselves as an artificial soil likewise appears not to have been previously attempted.

SUMMARY OF THE INVENTION

The use of continuous strips, or sheets, or grids, of synthetic materials to reinforce soils has several inherent disadvantages, which include: special construction techniques required; labor intensive installation; difficulty of manufacture; difficulty of placement; limitation in the improvement of soil engineering characteristics and soil index properties; cost of installation; difficulty of determining reinforced soil engineering characteristics with a high degree of accuracy; stress-strain characteristics; and, necessary horizontal or near-horizontal orientations which limit its effectiveness in some applications.

The use of fiber elements, intimately mixed to reinforce soil, although limited in research and published studies, appears to have the following limitations: Difficulty in mixing; decreased properties of compactibility; limited improvement in shear strength; different resistance to shear deformations resulting from different fiber element orientations; high threshold confining stresses; variable resistance to pull out; no rolling resistance; and difficulty in achieving an even distribution within the composite mixture.

A primary objective of the present invention is to produce a composite geotechnical engineering material with improved engineering characteristics and index properties, which can be controlled in both the laboratory and in the field environments so that improvements will be verifiable, significant, practicable, and predictable. Furthermore, an objective of the present invention is to provide several different methods of introducing the structural reinforcing elements into the soil to construct an improved composite geotechnical engineering material. Another objective of the present invention is to provide several different methods of introducing the structural reinforcing elements into the soil to construct an improved composite geotechnical engineering material. Another objective of the present invention is to provide synthetic, non-fibrous reinforcing elements by themselves, or essentially by themselves, as an artificial soil for certain geotechnical applications. Important features of these non-fibrous, discontinuous structural reinforcing elements include the following:

1. Designed resistance to shear displacement and deformations, including resistance to pull-out, resistance to rolling and resistance to sliding by interlocking.
2. Ease of mixing the structural reinforcing elements with the soil, by virtue of its three dimensional configuration rather than a fiber-like configuration.
3. Ability to place these structural reinforcing elements in layers for certain applications, rather than mixing them intimately with the soil to be reinforced.
4. Ability to construct light weight, but strong, reinforced soil or artificial soil, for special application where soil weight is a negative factor.
5. Ability of certain structural reinforcing elements to provide the same or similar resistance to shear deformation without regard to element orientation. This can result in predictable improvements in composite geotechnical engineering material performance.

Still other objects and advantages of the special designed structural reinforcing elements will become apparent upon reading the description of the preferred embodiments and alternate embodiments, in conjunction with the appended drawing figures.

DETAILED DESCRIPTION OF THE PREFERRED AND ALTERNATE EMBODIMENTS

Figure 1A:
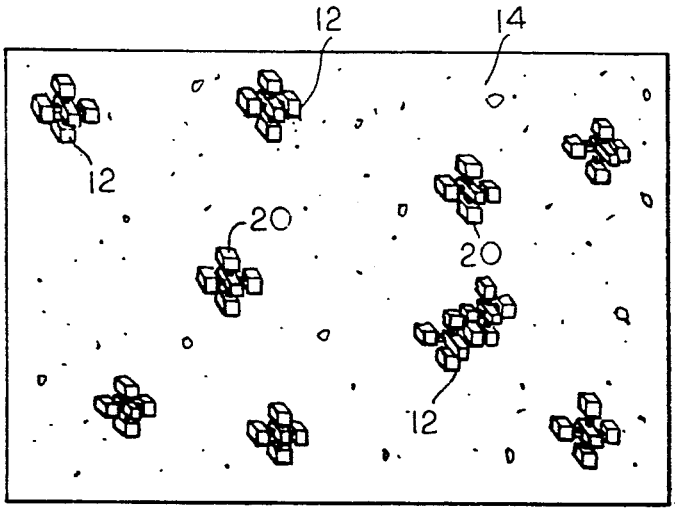
FIG. 1A is a partial side elevational view of a section of soil or other material, illustrating the present structural reinforcing elements in random orientation.
Figure 1B:
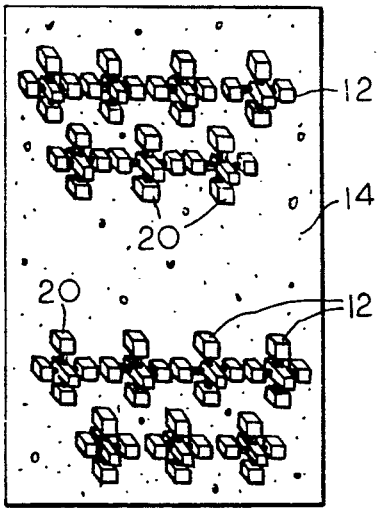
FIG. 1B is a partial side elevational view illustrating the placement of the present reinforcing elements in a layered configuration.

The practice of the present invention is to place discrete, non-fibrous structural reinforcing elements in a matrix of soil or stone, either by blending the elements 12 with the soil 14 as shown in FIG. 1A ("soil" as used herein refers to clay, silt, sand, Portland cement, concrete, asphalt, flyash, slag, lime, stone, and other construction engineering materials, and stone, or any proportion of a mixture thereof) or by placing the elements 12 in layers with the soil placed in layers on the elements as shown in FIG. 1B, or the elements, may be a used by themselves to form an "artificial" soil. Examples of the latter may be columnar configuration of elements spaced within a soil matrix, or an entire soil volume, such as behind a retaining wall, may be constructed of the structural reinforcing elements. Other uses can be seen by those skilled in the art.

The structural reinforcing elements may be constructed of any suitable material, including, but not limited to steel or other metals, wood or other natural materials, fiberglass, thermoplastic polymers and copolymers, to name the more obvious materials which could be utilized in a practical manner. Wood or other natural materials will have the disadvantages of deterioration in time due to organic decay, but still may be practicable under certain conditions and for limited life of the reinforced soil application.

The preferred material, considering manufacturing characteristics as well as material properties (including stress-strain characteristics, tensile strength, compressive strength, creep resistance, and density) is high density polypropylene, although many other manufacturable materials such as fiberglass, nylon, etc. may be used.

Figure 2C:
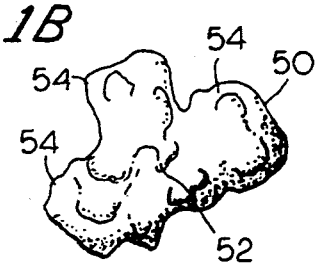
FIG. 2C is a perspective view of another alternate embodiment of the present invention.
Figure 2A:
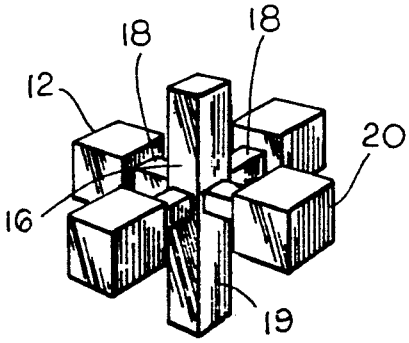
FIG. 2A is a perspective view of a first embodiment of the present invention.
Figure 2B:
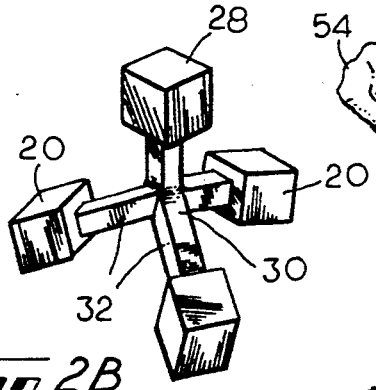
FIG. 2B is a perspective view of an alternate embodiment of the present invention.
Figure 3C:
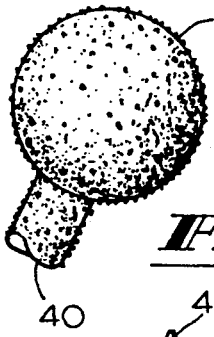
FIG. 3C is an enlarged perspective view of an alternate embodiment of a terminal end of the present reinforcing element.
Figure 3A:
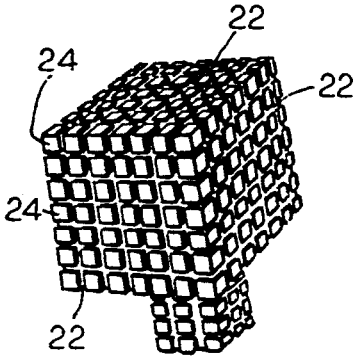
FIG. 3A is an enlarged perspective view of a first embodiment of the surface of the reinforcing element.
Figure 3B:
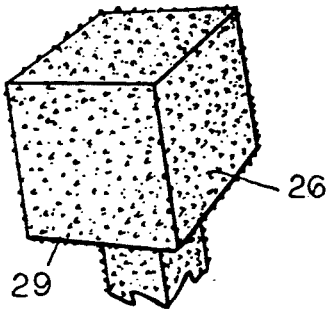
FIG. 3B is an enlarged perspective view of an alternate embodiment of the surface of the reinforcing element.
Figure 3D:
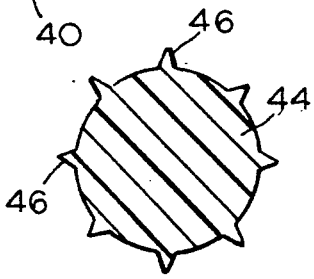
FIG. 3D is a cross-sectional view of a further alternate embodiment of the terminal end shown in the preceding figure.

The geometric configuration of the structural reinforcing element is important, as is the surface configuration of the element. Since a reinforcing element may tend to roll, slide or pull out as the soil matrix is stressed, resistance provided by the element to rolling, sliding, and pull out form the basis of its function in reinforcing the soil. In many applications (although not all applications), the element will be blended with the soil, and may therefore assume any possible random orientation with respect to a stress application, as shown in FIG. 1A. The element, ideally, should therefore provide the same, or as similar as practicable, resistance to rolling, sliding, or pull out in any possible orientation. The structural element should therefore ideally be three dimensional—and should have equal geometric shape in any orientation. However, for practical considerations in manufacturing, this ideal, multi-oriented similarity of configuration in any orientation, is difficult and costly to accomplish. A configuration which is also multi-oriented but in two dimensions, (with major structure in two dimensions) is suitable for certain applications. However, an element with major structure in three dimensions, although more difficult to manufacture, is preferred. Examples of possible dimensional configurations are illustrated in FIGS. 2A, 2B and 2C. FIG. 2A illustrates the element 12 having a central hub 16 with a plurality of spokes or arms 18 extending radially therefrom. The opposite ends of the arms 18 may be provided with matrix engaging means such as cubes 20. The cubes and arms may have a smooth surface, as shown in FIG. 2A, a surface containing gripping means such as groove means 22 and cubical protruding extensions 24 as shown in FIG. 3A, a roughened surface 26, similar to a coarse sandpaper, as shown in FIG. 3B, dimples, or like means for increasing the surface area thereof. A tetrahedral configuration is illustrated in FIG. 2B by element 28. Element 28 also includes a control hub 30, with arm means 32 emanating radially therefrom. Cubical matrix engaging means 20 are disposed at the ends of the arm means 32 opposite the hub 30. As with the previously described embodiment, the matrix engaging elements and arms may have a smooth outer surface, a grooved surface, a roughened surface, or other configuration which increases the surface area of the elements. Two additional possible configurations of the matrix engaging elements are shown in FIGS. 3C and 3D, when, in 3C a cylindrical arm 40 with a spherical member 42 is shown having a roughened surface. In FIG. 3D the spherical member 44 includes outwardly projecting spike means 46 as additional matrix engaging elements.

As noted hereinabove, an important aspect of the element configuration is the surface roughness or surface condition of the element. An element with a smooth surface, although it may improve the soil being reinforced, may not provide the same or similar resistance to rolling, sliding, or pull-out as would be provided by the same element with a rough surface. In addition to the above described surface configurations, the surface roughness may also be provided by indentations such as dimples on the surface, or by irregular grooves cut into the surface of the element. Other methods, such as sandblasting, or rough splitting, etc. can be utilized to form rough surfaces of the structural reinforcing elements.

Another embodiment of the present invention is illustrated in FIG. 2C. This element 50 is formed in an amorphous configuration, with a central hub portion 52 and a plurality of irregular matrix engaging members 54 randomly extending from the hub portion 52.

In the configuration of FIG. 1, the spokes or arms 18 each is of square or rectangular cross-section in a plane perpendicular to the axis of the arm 18. The hub 16 is a straight member, square or rectangular in cross-section in a plane perpendicular to the axis of hub 16. Arms 18 are fixed by their proximate ends to a central portion o the hub 16. The square of rectangular cross-section of each arm 18 in the plane perpendicular to the axis of the arm 18 is less than the cross-section area of the cube or gripping means 20. The inner and outer surfaces of cube 20 are flat, transverse, or perpendicular to the axis of arm 18.

The axes of arm 18 are in a plane which bisects the hub 16, this plane being perpendicular to the axis of the hub 16. The arms 18 radiate at 90° from each other. The hub 16 protrudes beyond the arms 18 on both sides of the plane of the axes of the arms 18. The width of the hub 16 is greater than the width of an arm 18.

The configuration of the non-fiber inclusion structural reinforcing element initially selected by the inventors for experimental work, was the configuration of a playing "jack" used primarily by children as a game. The "jack" is three dimensional, has six legs, is multi-oriented, and is, or can be, a structural element. It does not have equal geometric shape in all orientations, but it does have reasonably similar geometric shape in any given direction. It can theoretically provide significant resistance to rolling, sliding, and pull-out, regardless of element orientation. The jack used was made of a thermoplastic. Four of its six element extensions or arms including spherical balls at their ends. These four elements extensions were in the same plane. The two remaining element extensions were tapered columns, and they were perpendicular to the plane of the four element extensions with spherical ends.

The inventors have conducted two preliminary studies related to the invention. The first study involved the improvement in strength and stress-strain characteristics effected by the incorporation of discontinuous, multi-oriented inclusion elements in granular soil. Multistage, consolidated-drained triaxial tests were conducted on several samples of dry standard Ottawa sand and dry Ottawa sand reinforced with multi-oriented inclusions. Ottawa sand is a poorly-graded fine sand (Unified Soil Classification group symbol of SP). Two types of inclusions were used: (1) Commercial "jacks" as described above which were unaltered and had smooth surfaces, and (2) "jacks" which had Ottawa sand particles glued to their surface to provide roughness. All soil samples tested were 2.8 inches in diameter by 6 inches long. Reinforced samples were prepared by placing reinforcing elements in five layers within the sand matrix, thereby forming one inch horizontal intervals between layers of elements. No elements were placed at either the bottom or the top of the sample. The initial density of the sand in all samples (both unreinforced and reinforced) was 108 pcf. The initial density of the sand for the reinforced samples was maintained the same as for the unreinforced samples by calculating the volume of the inclusions and reducing the amount of sand accordingly. Therefore, any improvement in engineering properties and behavior of the reinforced soil can be attributed only to the presence of tee inclusions. For the following discussions, type A refers to unreinforced Ottawa sand, type B refers to Ottawa sand reinforced with 5.6% (by volume) unaltered (smooth) "jacks", and types C and D refers to Ottawa sand reinforced with 2.8% and 5.6% (by volume) rough "jacks", respectively.

The results of the triaxial tests are summarized in Tables 1 and 2. Comparison of types A and B with types C and D shows that the incorporation of rough "jacks" within the Ottawa sand, results in substantial improvement in the strength and stress-strain characteristics. The increases in the friction angles and cohesion intercepts (at effective confining stresses ranging from 3 to 50 psi) for types C and D compared to type A were substantial. The smooth surface "jacks" did not show a significant improvement in strength or stress-strain characteristics, in the Ottawa sand, however, they may improve soils other than dry sand.

The increase in strength from the rough structural reinforcing elements can best be illustrated by the ratio of deviator stress required to cause failure in the unreinforced sand. These values are shown in the last two columns of Table 1 for two ratios of axial to confining stress under which the samples were consolidated (Ko=0.4). For an effective confining pressure of 3 psi, strength, increases of 25% and 78% were achieved for types C and D, respectively, for isotropic consolidation (Ko=1.0). For anisotropic consolidation (Ko=1.4), the increases in strength were 76% and 236% for types C and D, respectively.

TABLE 1

Strength Parameters for Dense Ottawa Sand and Dense Ottawa Reinforced with Multi-Oriented Inclusions.

| Soil Type | Confining Stress 3 to 9 psi | Confining Stress 12 to 20 psi |
|---|---|---|
| A | 0 = 37.8 degrees; C = 0.2 psi | 0 = 35.2 degrees; C = 1.7 psi |
| B | 0 = 37.8 degrees; C = 0.2 psi | 0 = 35.2 degrees; C = 1.7 psi |
| C | 0 = 39.8 degrees; C = 0.8 psi | 0 = 38.4 degrees; C = 1.5 psi |
| D | 0 = 42.5 degrees; C = 2.0 psi | 0 = 42.2 degrees; C = 2.0 psi |

| Soil Type | F* | Ratio** Ko = 1.0 | Ratio** Ko = .04 |
|---|---|---|---|
| A | 11.2 psi | 1.00 | 1.00 |
| B | 11.2 psi | 1.00 | 1.00 |
| C | 14.0 psi | 1.25 | 1.76 |
| D | 19.9 psi | 1.78 | 3.35 |

*F = Difference in principal stresses at failure
**Ratio = Ratio of confining stresses at failure; reinforced soil divided by unreinforced soil

TABLE 2

Stress-Strain Parameters for Dense Ottawa Sand and Dense Ottawa Sand Reinforced with Multi-Oriented Inclusions at Effective Confining Pressure = 3 psi.

| Soil Type | 50% Strain* | Modulus** | Strain at Failure |
|---|---|---|---|
| A | 0.57% | 1.0 ksi | 3.8% |
| B | 0.57% | 1.0 ksi | 3.8% |
| C | 0.13% | 5.6 ksi | 1.4% |
| D | 0.21% | 4.7 ksi | 1.3% |

*50% Strain = At 50% of ultimate strength
**Modulus = Modulus at 50% strain

The increases in stress-strain characteristics caused by the reinforcement (Table 2) was even greater than the strength increases. The secant modulus at 50% of peak deviator stress for Types C and D was increased by 460% (5.6 times) and 370% (4.7 times) that of the unreinforced Type A. In addition, a comparison of the stress-strain curves for the roughly reinforced and unreinforced samples showed that only a small amount of deformation is necessary to mobilize the strengthening effect of the multi-oriented inclusion elements, in contrast to geosynthetic and other types of strip reinforcement, which require significant deformation to mobilize their tensile strength.

The results from triaxial tests demonstrated clearly that significant improvements in strength and stress-strain characteristics of soils can be obtained through the inclusions of discontinuous, non-fibrous structural reinforcing elements in sand. Another important improvement was in mode of failure. The unreinforced soil failed by a well-defined failure plane which visibly showed the displacement shear surface created during shear failure. The reinforced soil did not form a definable shear surface, but failed by bulging. Furthermore, after the reinforced tests were performed, the rubber membranes surrounding the samples were carefully rolled down to expose the samples. The unreinforced sample collapsed immediately upon removal of the membrane, whereas the reinforced samples maintained generally their cylindrical configuration (with only minor spalling of the soil around the edges). This comparison indicates the substantial increase in stability created by inclusion of the elements within the soil.

In the second study, two laboratory CBR tests were performed to estimate qualitatively the potential effectiveness of incorporated columns of reinforced material within the matrix soil. The first CBR test was conducted on an unreinforced sample of very soft clayey silt, while the second CBR test was performed on a nearly identically prepared sample of the same clayey silt that was reinforced with a single 1.0 in. diameter, 4 in. deep column of well-graded sand with rough "jacks". The column was formed by pushing a 0.5 in. diameter rod into the matrix soil and vibrating it back and forth to create the approximately 1.0 in. diameter column. The columnar material consisting of sand and "jacks" was compacted vertically and laterally in layers within the void. The CBR value for the reinforced soil was 733% greater than the unreinforced clayey silt.

The results from this study demonstrated qualitatively the viability of using discontinuous, multi-oriented structural inclusion elements to enhance the bearing strength of a subgrade by placing them in a columnar orientation.

An improved configuration for the structural reinforcing elements is shown in FIGS. 1A through 3D. Also, as shown in FIG. 2A, the two vertical element extension have the same length and mass as the four element extensions in the perpendicular plane. Surface roughness may be incorporated by several methods including cutting grooves in the element surfaces. Some other general configurations which may be utilized for structural reinforcing elements are shown. These are only a few of the possible two dimensional and three dimensional configurations which could be used. Other geometries will be developed in time to produce different shaped inclusion elements for different uses. The elements may range from smaller than 0.5 inches in outside dimension to greater than six inches in outside dimension, depending on the environment in which they will be placed.

With significant improvements in soil shear strength, stress-strain characteristics, increased permeability, and decreased density, the following uses are seen at this time for non-fiber inclusion structural reinforcing elements: Reinforced subgrades for pavement design construction; reinforced subbases and base courses for pavement design and construction; stabilization of soft or loose soils for general construction, for slab support, for footing support, and for roadway and airfield support (including non-paved roadways and airfields); retaining wall backfill for reinforced soil retaining wall design and construction; reinforced soil columns to improve foundation bearing soils; slope reinforcement to stabilize slopes, including improvement in stability of existing slopes as well as design and construction of steeper slopes utilizing the structural reinforcing elements; seawall backfill and reinforced seawall design; improved strength and stress-strain characteristics of other construction materials, in addition to soil, including, but not limited to, concrete, asphalt, and stone.

It should be apparent from results of the experiments described that the inclusion of non-fibrous structural reinforcing elements within the soil or other material matrix, can produce significant improvements in engineering properties and index properties. Thus, while an embodiment and modification thereof have been shown and described in detail herein, various additional changes and modifications may be made without departing from the scope of the present invention.

We claim:

1. A three-dimensional structural reinforcing element for inclusion on or within a soil matrix, said reinforcing element being a unitary, substantially rigid member and comprising a hub, a plurality of arms radiating from said hub, each arm having a proximal end and a distal end, the proximal end of all of said arms being connected to said hub, said arms radiating outwardly from said hub, cubic gripping means respectively associated with and integrally joined to the distal ends of said arms, each of said gripping means having a larger transverse area than the cross-sectional area of its associated arm and said hub protruding outwardly of said gripping means on both sides of said arms.

2. The reinforcing element defined in claim 1 wherein said gripping means have inner surfaces and are disposed in a common plane and are circumferentially equally spaced from each other around said hub, said inner surfaces extending transversely of and away from their associated arms.

3. The structural reinforcing element defined in claim 1 wherein certain of said arms are disposed in a common plane and the hub is disposed along an axis perpendicular to said common plane, and protrudes in opposite directions from said common plane and beyond said gripping members.

4. The structural element defined in claim 3 wherein said remaining arms are of equal length and protrude from diametrically opposed portions on said hub.

5. The structural reinforcing element defined in claim 1 wherein said gripping means are each cubic in shape.

6. The structural reinforcing element defined in claim 1 wherein said certain of said arms are disposed in a common plane approximately 90° from each other around said hub.

7. The structural reinforcing element defined in claim 1 wherein said arms are each rectangular in cross-section and said hub is formed by the intersection of the proximal ends of said arms.

8. The structural reinforcing element defined in claim 1 wherein said element is composed of rigid plastic material.

9. The structural reinforcing element defined in claim 1 wherein said gripping means have rough surfaces of increased surface area with respect to the cross-section of their respective arms for providing increased engagement with said matrix and for providing increased resistance to movement within a matrix formed by said soil.

10. The structural reinforcing element defined in claim 1 in which surfaces of said gripping means are perpendicular to the axis of its associate arms for increasing engagement with the soil and for providing increased resistance to the movement of said soil.

11. The structural reinforcing element defined in claim 1 wherein the largest dimension of said element is between about 0.1 inch and about 18 inches.

12. The structural reinforcing element defined in claim 1 wherein said structural element is constructed of material selected from the group consisting of thermoplastics, concrete, fiberglass, wood, bamboo, and metals.

13. The three dimensional, structural, reinforcing element defined in claim 1 wherein said arms radiate at right angles to each other from said hub.

14. A structure formed of a matrix material and a plurality of three dimensional, discrete, unconnected, reinforcing elements each of which has a hub and a plurality of arms protruding radially in different directions therefrom, enlarged gripping members on the end of said arms, said elements being disposed in said matrix material for improving the shear strength, deformation characteristics, permeability, workability or plasticity or the matrix material, said reinforcing element being disposed randomly within said matrix, said hub protruding in opposite directions beyond said arms.

15. The structure defined in claim 14 wherein said reinforcing elements comprise from approximately 0.1% to approximately 50%, by weight of the structure.

16. The structure defined in claim 14 wherein said structure is disposed below ground.

17. A process of producing a reinforced soil matrix having improved engineering and index properties comprising, intimately admixing, with soil, a plurality of individual three dimensional discrete reinforcing elements which when mixed are disposed within the soil matrix in random spaced relationship to each other, said reinforcing elements each being composed of solid plastic material and each including a hub, arms radiating from said hub, and gripping elements on the ends of said arms, said gripping elements each being cubic and larger in cross-sectional are transversely of its arms than the transverse cross-sectional area of said arms for resisting movement of increments of soil with which the reinforcing elements are admixed.

* * * * *